US008037919B2

(12) United States Patent
Yu Chen

(10) Patent No.: US 8,037,919 B2
(45) Date of Patent: Oct. 18, 2011

(54) DOUBLE-SIDED ADHESIVE TAPE DISPENSER AVAILABLE FOR DIVERSE WIDTHS

(76) Inventor: Hsiu-Man Yu Chen, Tan Tzu Hsiang (TW)

( * ) Notice: Subject to any disclaimer, the term of this patent is extended or adjusted under 35 U.S.C. 154(b) by 358 days.

(21) Appl. No.: 12/292,783

(22) Filed: Nov. 26, 2008

(65) Prior Publication Data

US 2010/0126671 A1 May 27, 2010

(51) Int. Cl.
*B65H 35/07* (2006.01)

(52) U.S. Cl. ..... 156/577; 156/579; 156/344; 156/391; 156/494; 156/495; 156/540; 242/334; 242/410; 242/412; 242/538; 242/588

(58) Field of Classification Search ..... 156/44, 156/391, 392, 494, 495, 496, 523, 574, 577, 156/579, 344, 526, 385, 540, 527, 304.3; 242/334, 155 R, 381.4, 410, 412, 538.1, 538.2, 242/588, 588.2, 588.6
See application file for complete search history.

(56) References Cited

U.S. PATENT DOCUMENTS

| | | | | |
|---|---|---|---|---|
| 4,582,558 | A * | 4/1986 | Antonson | 156/523 |
| 2006/0144512 | A1 * | 7/2006 | Carroll et al. | 156/304.3 |
| 2006/0260762 | A1 * | 11/2006 | Yu Chen | 156/584 |

* cited by examiner

*Primary Examiner* — Khanh Nguyen
*Assistant Examiner* — Keith T Aziz
(74) *Attorney, Agent, or Firm* — Bacon & Thomas PLLC

(57) ABSTRACT

A double-sided adhesive tape dispenser available for diverse width includes a main body and a winding mechanism installed inside the main body. The winding mechanism has a driving gear and a recycling gear fitted with a recycling wheel. The driving gear and the recycling gear are respectively mounted with a first adjusting member and a second adjusting member that have a certain height. A tape disk is fitted on the first adjusting member. With or without the first adjusting member and the second adjusting member, adhesive tapes with diverse widths can be applied by the adhesive tape dispenser of the invention without using an additional conventional adhesive tape dispenser.

4 Claims, 6 Drawing Sheets

DOUBLE-SIDED ADHESIVE TAPE DISPENSER AVAILABLE FOR DIVERSE WIDTHS

BACKGROUND OF THE INVENTION

1. Field of the Invention

This invention relates to a double-sided adhesive tape dispenser available for diverse widths.

2. Description of the Prior Art

As shown in FIG. 1, a conventional tape appliance includes a shell 1, a hood 2 covered on the shell 1, a first fixing shaft 3 and a second fixing shaft 4 respectively mounted with a driving gear 5 and a recycling gear 6 engaging with each other. In addition, a tape disk 7 is pivotally positioned on the driving gear 5 and a recycling wheel 8 is pivotally set on the recycling gear 6. Positioned at the front of the shell 1 is a tape-dispensing base 9 used to move the tape placed on the tape disk 7 so that a separable paper is then wound around the recycling wheel 8.

While the conventional adhesive tape dispenser can be operated to keep an object adhered with the adhesive tape to fix it, it can only be restrictively installed with a certain width of the tape coil 7, unavailable for tapes of different widths unless using another adhesive tape dispenser. So, it is very inconvenient for a user; moreover, it steps up cost, too.

SUMMARY OF THE INVENTION

The object of this invention is to offer a double-sided adhesive tape dispenser available for diverse widths.

The main characteristics of the invention are a main body and a winding mechanism installed in the main body. The winding mechanism includes a driving gear and a recycling gear fitted with a recycling wheel. The driving gear and the recycling gear are respectively mounted with a first adjusting member and a second adjusting member that have a certain height. A tape disk is fitted on the first adjusting member. With the first adjusting member and the second adjusting member respectively fitted on the driving gear and the recycling gear, a narrower width of tape can be applied by the adhesive tape dispenser of the invention instead of additionally using another conventional tape appliance for a narrower tape.

BRIEF DESCRIPTION OF DRAWINGS

This invention is better understood by referring to the accompanying drawings, wherein.

DETAILED DESCRIPTION OF THE PREFERRED EMBODIMENT

Figure 1:
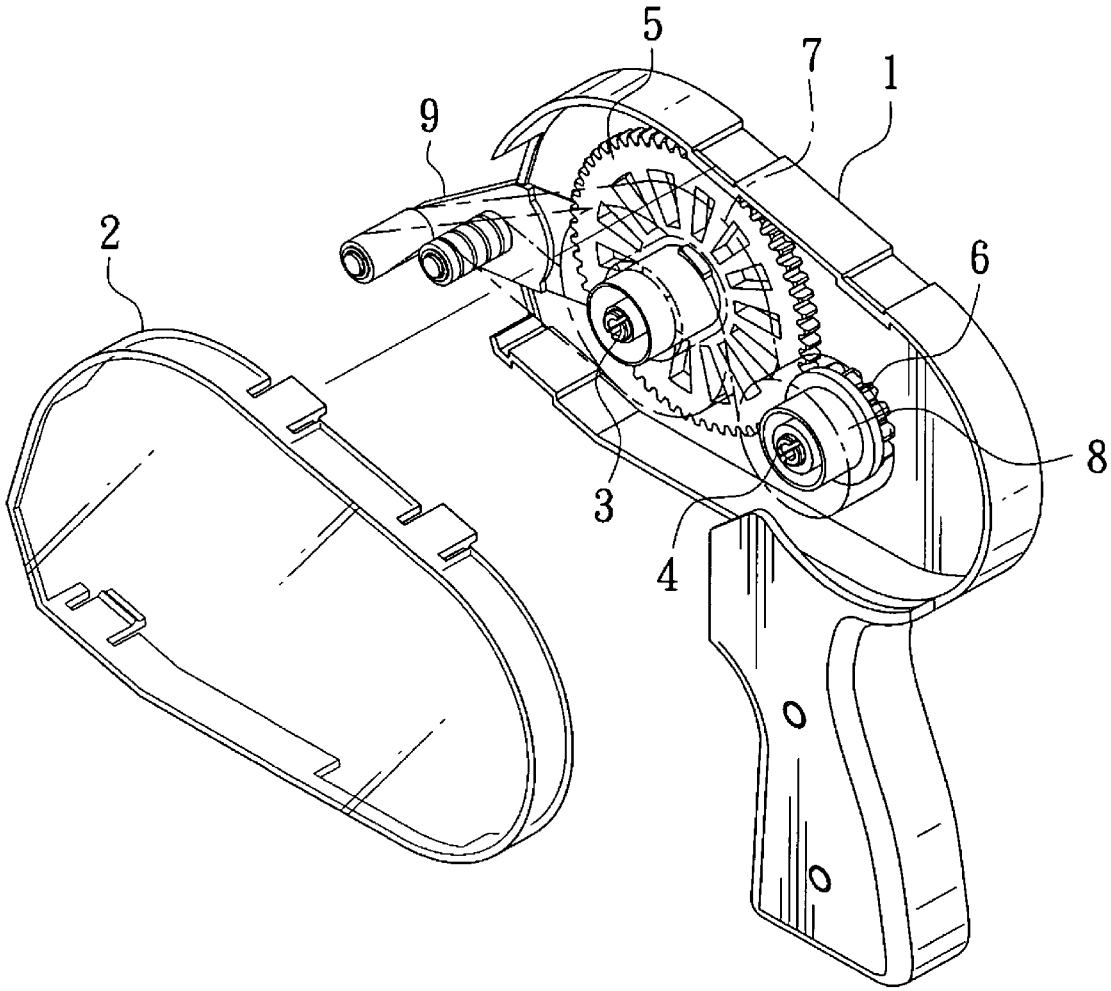
FIG. 1 PRIOR ART
FIG. 1 is a perspective view of a conventional tape appliance with a hood removed.
Figure 2:
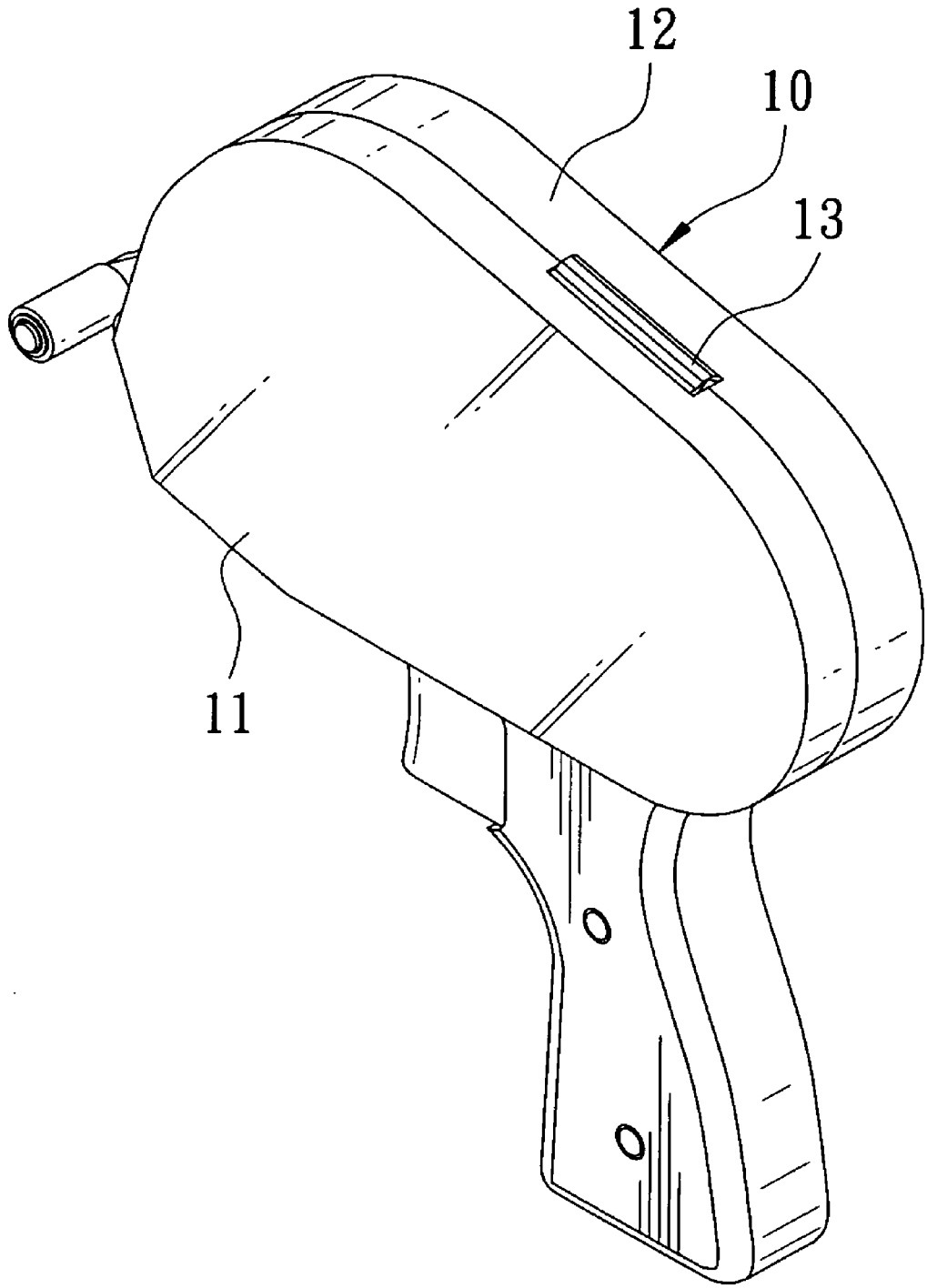
FIG. 2 is a perspective view of a preferred embodiment of a double-sided tape dispenser available for diverse widths in the present invention.
Figure 3:
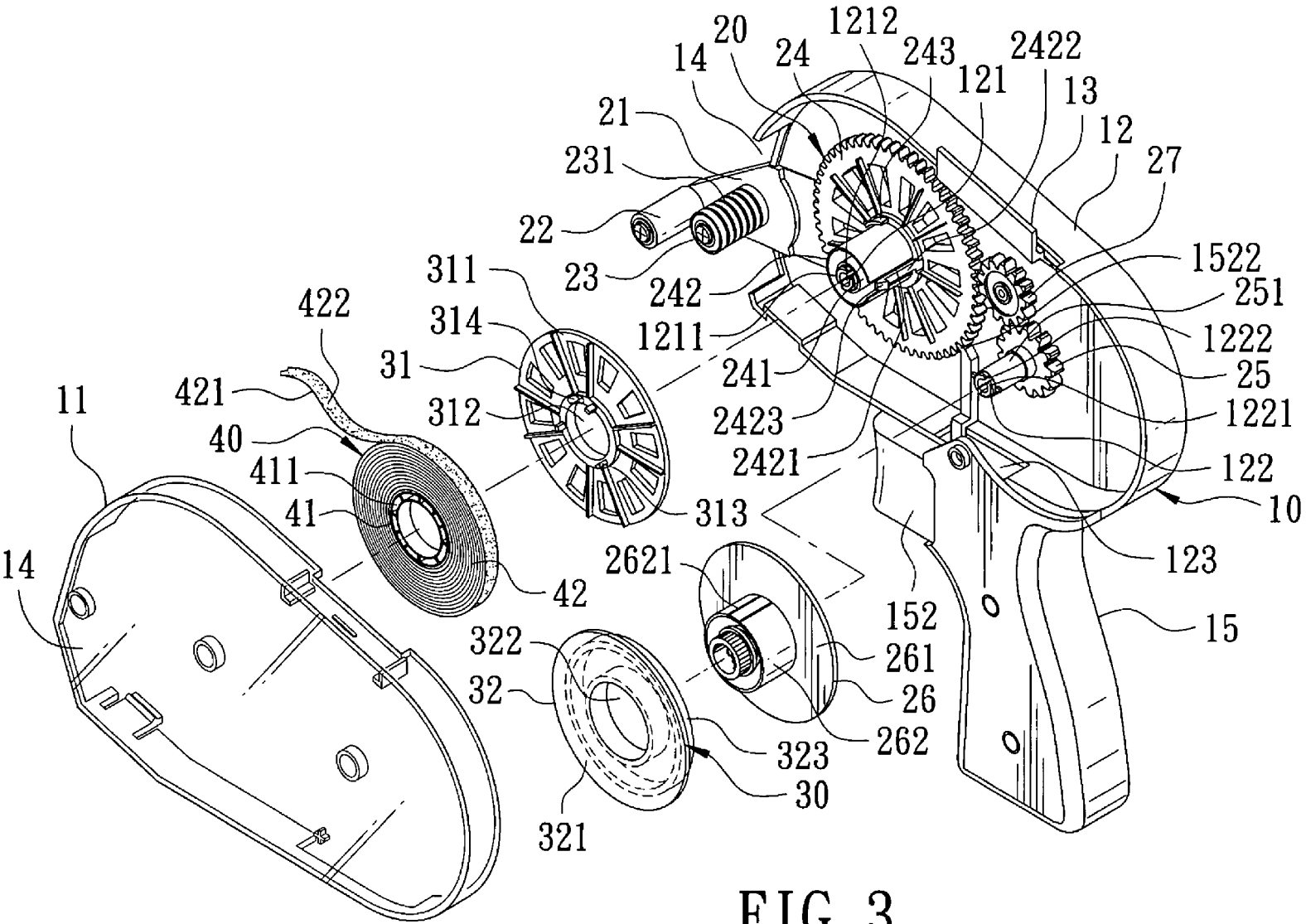
FIG. 3 is an exploded perspective view of the preferred embodiment of a double-sided adhesive tape dispenser available for diverse widths in the present invention.

As shown in FIGS. 2 and 3, a preferred embodiment of a double-sided tape dispenser available for diverse widths consists of a main body 10, a winding mechanism 20, an adjusting unit 30 and a tape coil 40.

The main body 10 includes a first shell 11, a second shell 12, and a pivotal connecting portion 13 respectively formed at a corresponding upper portion of the first and the second shell 11 and 12 for enabling the first shell and the second shell locked together or separated apart. The second shell 12 is provided with a first fixing shaft 121 and a second fixing shaft 122, which are formed tubular, vertically protruded from its inner wall and properly spaced apart. The first fixing shaft 121 is provided with a locking rim 1211 radially formed around its top annular edge, and a slot 1212 axially cut down from the top. The second fixing shaft 122 is also provided with a locking rim 1221 radially formed around its top surface, and a slot 1222 axially cut down from its top surface. In addition, respectively formed in a corresponding front portion of the first shell 11 and the second shell 12 is a tape outlet 14.

Figure 4:
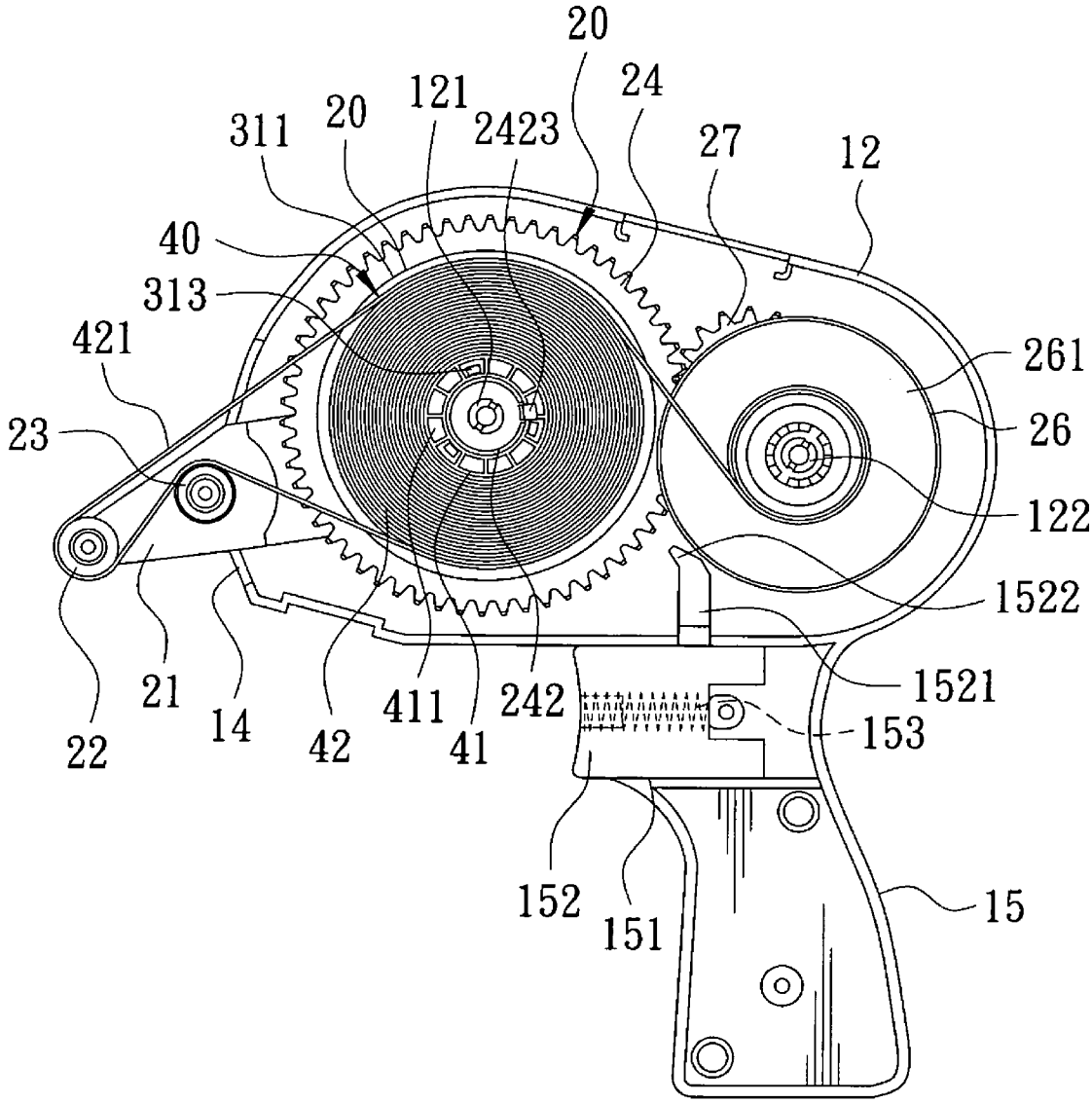
FIG. 4 is a side cross-sectional view of the preferred embodiment of a double-sided adhesive tape dispenser available for diverse widths in the present invention.

Moreover, as shown in FIG. 4, the main body 10 is further provided with a grip 15 formed at one side of the second shell 12 opposite to the tape outlet 14. The grip 15 is provided with a sliding groove 151 formed in its front side, a control block 152 fitted in the sliding groove 151, and a compression spring 153 installed between an inner wall of the control groove 151 and the control block 152. The control block 152 is provided with a control bar 1521 extended upward from its top to pass through a notch 123 formed in the bottom of the second shell 12 and move to and fro therein, and a locking tooth 1522 transversely formed at a tip of the free end of the control bar 1521.

The winding mechanism 20 is installed inside the second shell 12, provide with a tape dispensing base 21 formed as a long plate, a pressing roller 22 positioned on an outermost portion of the tape dispensing base 21 and exposed outside the main body 10, and a conveying roller 23 properly positioned inwards on the tape dispensing base 21 and next to the pressing roll 22. The conveying roller 23 is provided with a plurality of annular rims 231 formed around the circumferential surface and properly spaced apart. Pivotally mounted around the first fixing shaft 121 is a driving gear 24, which is lockable with the locking tooth 1522 of the control block 152, provided with a first restricting tube 241, an axial sleeve 242 and a restricting block 243 axially extended outward from the central portion. The first fixing shaft 121 is inserted inside the first restricting tube 241, with the locking rim 1211 restrictively resting on the top of the first restricting tube 241 and the slot 1212 elastically blocked inside the restricting tube 241 immovably. The axial sleeve 242 is positioned around the first restricting tube 241, provided with two adjacent ditches 2421 axially formed in the outer wall, and a long plate 2422 fixed between the ditches 2421 and having its top extended outward to form a triangular locking tip 2423. The restricting block 243 is an arc-shaped plate, installed outside and properly spaced apart from the axial sleeve 242. The second fixing shaft 122 is pivotally mounted with a recycling gear 25 that is provided with a second restricting tube 251 axially extended outward from the central portion for being inserted by the second fixing shaft 122, with the locking rim 1221 restrictively resting on the top of the second restricting tube 251 and the slot 1222 elastically blocked inside the restricting tube 251 immovably. A recycling wheel 26 is pivotally mounted around the recycling gear 25, provided with a disc 261, a reel 262 axially extended outward from the central portion of the disc 261 for being pivotally mounted around the second restricting tube 251. The reel 262 is provided with two adjacent clamping grooves 2621 axially formed in the outer wall. Furthermore, a gear 27 is installed between and engaged with the driving gear 24 and the recycling gear 26.

The adjusting unit 30 is installed on the winding mechanism 20, provided with a first adjusting member 31 and a second adjusting member 32 respectively having a preset height. The first adjusting member 31 is mounted on a side of the driving gear 24, provided with a disc 311, a through hole 312 bored at the center of the disc 311 to be correspondingly inserted through by the axial sleeve 242, three restricting projections 313 axially extended up from the circumference of the through hole 312 and equidistantly spaced apart, and a restricting hole 314 bored in the disc 311 between two adjacent restricting projections 313 for corresponding to the restricting block 243. The second adjusting member 32 is mounted around the recycling wheel 26, provided with a disc 321, a through hole 322 bored at the center to be correspondingly inserted through by the reel 262, and two annular supporting rims 323 axially formed around the underside of the disc 32 and appropriately spaced apart for resting on the disc 261 of the recycling wheel 26. In the preferred embodiment, the first adjusting member 31 and the second adjusting member 32 can be made with diverse heights.

The tape disk 40 is installed on the first adjusting member 31, provided with a reel 41 having a certain thickness and dug with plural locking holes 411 utilized to be fitted with the restricting projections 313, and a double-sided adhesive tape 42 wound around the reel 41. The double-sided adhesive tape 42 includes a separable paper 421 that is wound to orderly pass through the top of the conveying roller 23 and the bottom of the pressing roller 22 and then fixed in the clamping groove 2621 of the reel 262, and a double-sided adhesive sheet 422 adhered on the separable paper 421.

In using, as shown in FIGS. 3 and 4, the first adjusting member 31 and the second adjusting member 32 are first fitted with the driving gear 24 and the recycling wheel 26 respectively. Next, the tape disk 40 is fitted on the first adjusting member 31, with the separable paper 421 of the double-sided adhesive tape 42 orderly wound to pass through the conveying roller 23 and the pressing roller 22 and then fixed in the clamping groove 2621 of the reel 261. Then, the first shell 11 is connected with the second shell 12, with the corresponding connecting portions 13 locked together. By the time, the control block 152 can be pressed to move inward along the sliding groove 151 so as to keep the locking tooth 1522 separated from the driving gear 24. And, the bottom of the pressing roller 22 can be successively put to contact an object. With the double-sides adhesive sheet 422 glued on the object and the pressing roller 22 functioned as a pivot, the double-sided adhesive tape dispenser can be pulled back to keep the pressing roller 22 rotating on the object, so that the double-sided adhesive sheet 422 can be separated from the separable paper 421 to adhere on the object and the separable paper 421 can be further wound around the reel 262 for recycling.

Figure 5:
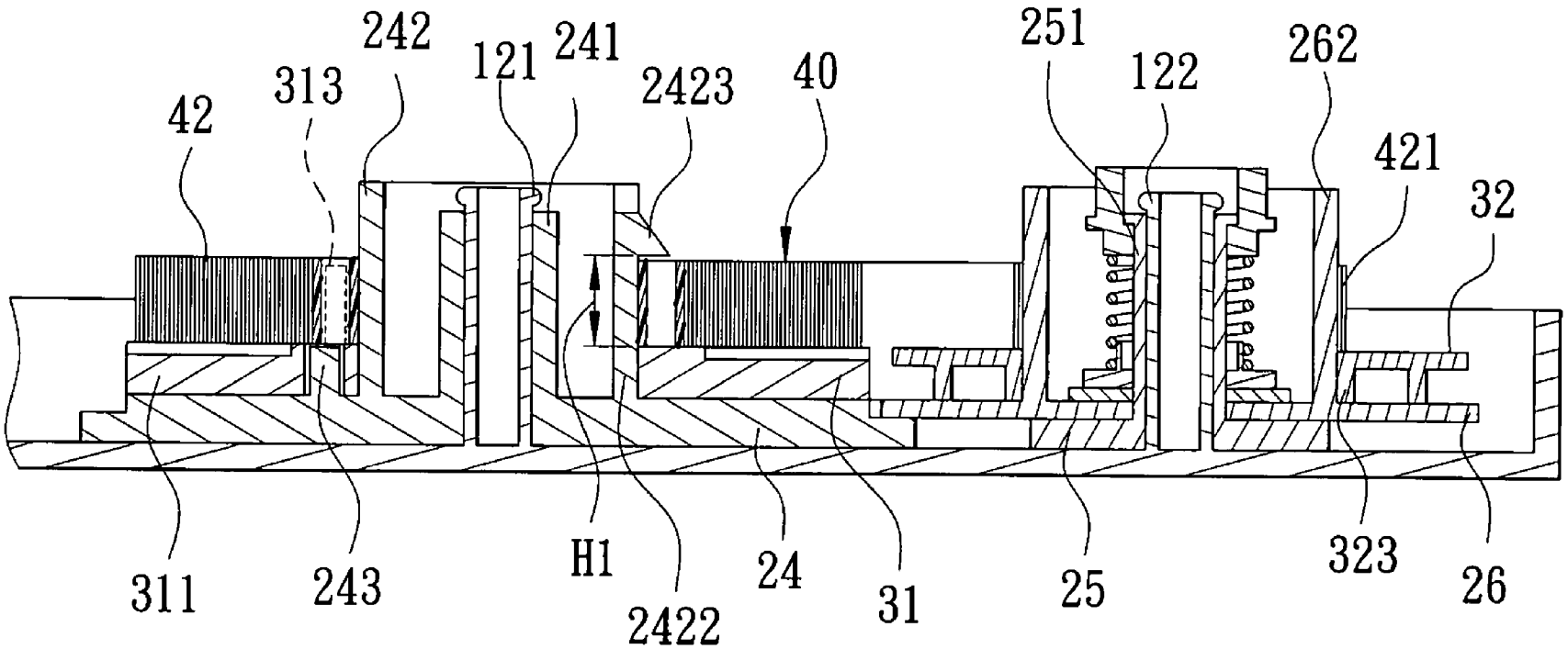
FIG. 5 is partial cross-sectional view of FIG. 4, showing it being installed with a first adjusting member and a second adjusting member.

It is to be noted that, as shown in FIG. 5, when the first adjusting member 31 and the second adjusting member 32 are respectively put on the driving gear 24 and the recycling wheel 26, only a narrow tape coil 40 can be fitted on the first adjusting member 31, with the locking tip 2423 to keep the tape coil 40 restricted on the first adjusting member 31. Thus, a first height (H1) is a distance measured from the top of the disc 311 to the lower edge of the locking tip 2423.

Figure 6:
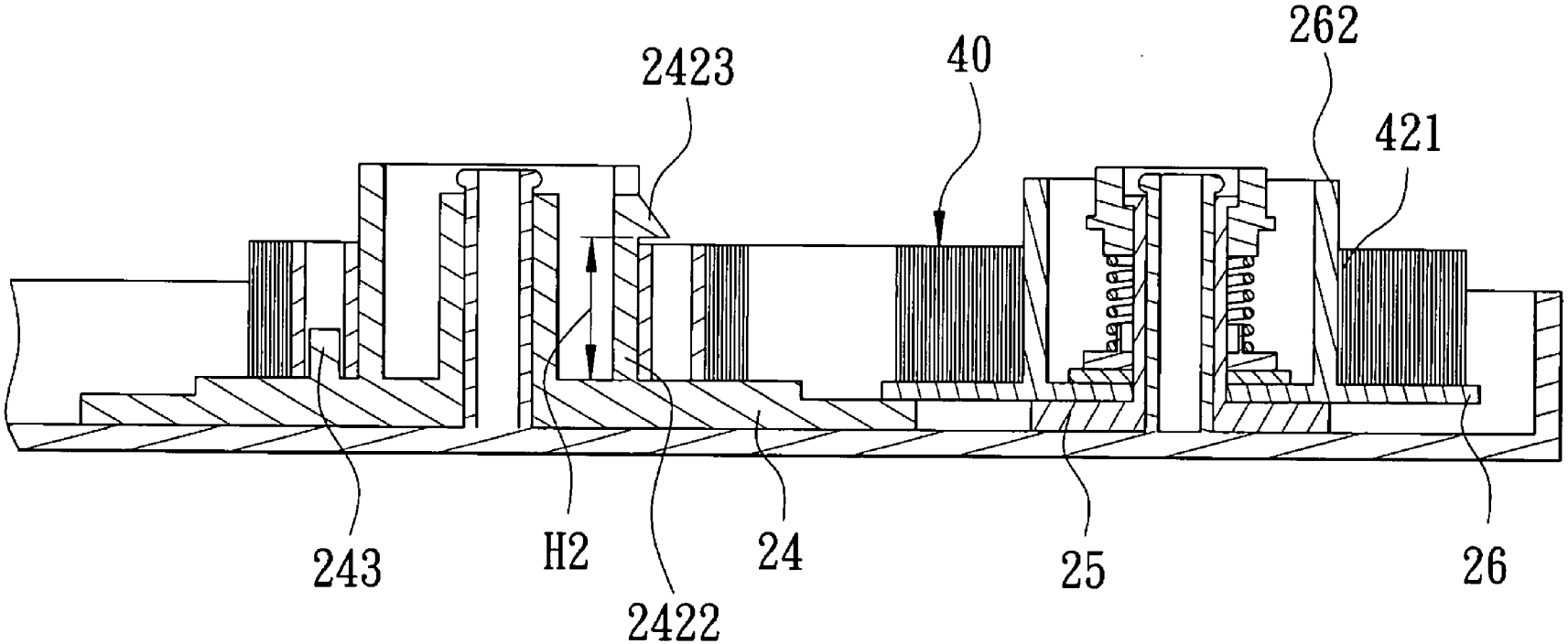
FIG. 6 is another partial cross-sectional view of the preferred embodiment of the present invention, showing it not being installed with the first adjusting member and the second adjusting member.

And, FIG. 6 shows a cross-sectional view of the present invention without installation of the first adjusting member 31 and the second adjusting member 32. That is, if a wider tape coil 40 is to be applied, the first adjusting member 31 and the second adjusting member 32 can be removed from the driving gear 24 and the recycling wheel 26 so that the tape disk 40 can be directly installed on the driving gear 24 as a taller second height (H2) between the top of the disc 311 and the lower edge of the locking tip 2423 is achieved.

While the preferred embodiment of the invention has been described above, it will be recognized and understood that various modifications may be made therein and the appended claims are intended to cover all such modifications that may fall within the spirit and scope of the invention.

What is claimed is:

1. A double-sided adhesive tape dispenser available for diverse tape widths, said appliance comprising a main body, a winding mechanism installed inside said main body and provided with a driving gear and a recycling gear that is mounted with a recycling wheel; and said double-sided adhesive tape dispenser characterized by having said driving gear and said recycling wheel respectively fitted with a first adjusting member and a second adjusting member that have a preset height, said first adjusting member mounted with a tape disk, wherein said driving gear is provided with a first restricting tube and an axial sleeve and a restricting block axially extended outward from a central portion, said first restricting tube surrounded by said axial sleeve that is provided with two adjacent ditches axially formed in its outer wall, a long plate fixed between said ditches and having its top extended outward to form a triangular locking tip, a restricting block installed outside and properly spaced apart from said axial sleeve, wherein said first adjusting member is provided with a disc with a preset thickness, a through hole bored at a center of said disc to correspond to said axial sleeve, three restricting projections axially extended up from a circumference of said through hole and equidistantly spaced apart, a restricting hole bored in said disc between two adjacent said restricting projections for corresponding to said restricting block of said driving gear.

2. The double-sided adhesive tape dispenser available for diverse widths as claimed in claim 1, wherein said tape disk is provided with a reel having a certain thickness and dug with plural locking holes for being locked with said restricting projections, a double-sided adhesive tape wound around said reel and including a separable paper that is adhered with a double-sided adhesive sheet.

3. The double-sided adhesive tape dispenser available for diverse widths as claimed in claim 1, wherein said recycling wheel is provided with a disc, a reel axially extended outward from a central portion of said disc, two adjacent clamping grooves axially formed in an outer wall of said reel.

4. The double-sided adhesive tape dispenser available for diverse widths as claimed in claim 3, wherein said second adjusting member is provided with a disc having its center bored with a through hole for corresponding to said reel of said recycling wheel.

* * * * *